US009119522B1

(12) United States Patent
Barksdale

(10) Patent No.: US 9,119,522 B1
(45) Date of Patent: Sep. 1, 2015

(54) DISH WASHER SIGN SYSTEMS

(71) Applicant: Stuart Barksdale, Elmsford, NY (US)

(72) Inventor: Stuart Barksdale, Elmsford, NY (US)

( * ) Notice: Subject to any disclaimer, the term of this patent is extended or adjusted under 35 U.S.C. 154(b) by 30 days.

(21) Appl. No.: 14/243,529

(22) Filed: Apr. 2, 2014

Related U.S. Application Data

(60) Provisional application No. 61/812,898, filed on Apr. 17, 2013.

(51) Int. Cl.
*G08B 21/00* (2006.01)
*A47L 15/42* (2006.01)

(52) U.S. Cl.
CPC ..... *A47L 15/4293* (2013.01)

(58) Field of Classification Search
CPC ..... A47L 15/0002; A47L 15/0086; A47L 15/0028; G09F 23/0058
USPC ..... 340/679, 525, 539.1, 691.6, 815.4; 40/584
See application file for complete search history.

(56) References Cited

U.S. PATENT DOCUMENTS

| | | | | |
|---|---|---|---|---|
| 4,129,954 | A | 12/1978 | Hulteen | |
| D345,829 | S | 4/1994 | Mancuso et al. | |
| 5,467,545 | A | 11/1995 | Zillner | |
| 5,839,458 | A * | 11/1998 | Delcarson | 134/113 |
| 5,884,641 | A * | 3/1999 | Berg | 134/113 |
| 6,196,239 | B1 * | 3/2001 | Eskey | 134/113 |
| 7,516,746 | B1 * | 4/2009 | Davis | 134/113 |
| 2005/0024330 | A1 * | 2/2005 | Astrauskas | 345/158 |

* cited by examiner

*Primary Examiner* — Phung Nguyen
(74) *Attorney, Agent, or Firm* — RG Patent Consulting, LLC; Rachel Gilboy

(57) ABSTRACT

A dishwasher cycle visual indicator system has a dishwasher cycle visual indicator assembly including a housing having a front-side, a back-side, a top-side, a bottom-side, a left-side, a right-side, and an inner-volume; a plurality of lights for displaying at least one message according to a condition realized within a dishwashing appliance; a powerer; a wiring assembly; a wireless receiver; and at least one attacher. The dishwasher cycle visual indicator assembly includes in functional combination the housing, the plurality of lights, the powerer, the wiring assembly, the wireless receiver, and the at least one attacher.

17 Claims, 3 Drawing Sheets

DISH WASHER SIGN SYSTEMS

CROSS-REFERENCE TO RELATED APPLICATION

The present application is related to and claims priority from prior provisional application Ser. No. 61/812,898, filed Apr. 17, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of notification devices and more specifically relates to a dishwasher cycle visual indicator system to indicate, at a glance, whether the dishes in the washer are clean and ready for removal or are dirty.

2. Description of the Related Art

A dishwasher is a mechanical device for cleaning dishes and eating-utensils. Dishwashers can be found in restaurants and private homes. Unlike manual dishwashing, which relies largely on physical scrubbing to remove soiling, the mechanical dishwasher cleans by spraying hot water, typically between 55 to 75° C. (130 to 170° F.) at the dishes, with lower temperatures used for delicate items. A mix of water and detergent is circulated by a pump. Water is pumped to one or more rotating spray arms which 'blast' the dishes with the cleaning mixture.

Once the wash is finished, the water is drained, more hot water is pumped in and a rinse cycle begins. After the rinse cycle finishes and the water is drained, a heating element in the bottom of the tub heats the air to dry the dishes. Sometimes a rinse aid is used to eliminate water spots for streak-free dishes. Approximate 60 percent of households in the United States are equipped with an electric dishwasher; in those households, on a near-daily basis, someone is continually having to open the dishwasher door to determine whether the dishes inside have been washed, or need to be. An easy to use and simple visual indication means is desirable such that the problem can be solved.

Various attempts have been made to solve problems found in visual indicator art. Among these are found in: U.S. Pat. No. 5,467,545 to Jospeh W. Zillner; U.S. Pat. No. 4,129,954 to James M. Hulteen; and U.S. Pat. No. D345,829 to Ingrid M. Mancuso et al. This prior art is representative of indicators used with appliances. None of the above inventions and patents, taken either singly or in combination, is seen to describe the invention as claimed.

Ideally, a walker dishwasher cycle visual indicator system should be user-friendly, handy, and safe in-use and, yet would operate reliably and be manufactured at a modest expense. Thus, a need exists for dishwasher cycle visual indicator system to indicate, at a glance, whether the dishes in the washer are clean and ready for removal or are dirty and to avoid the above-mentioned problems.

BRIEF SUMMARY OF THE INVENTION

In view of the foregoing disadvantages inherent in the known of notification devices art, the present invention provides a novel dishwasher cycle visual indicator system (Dish Washer Sign Systems). The general purpose of the present invention, which will be described subsequently in greater detail is to provide a specially designed dishwasher cycle visual indicator system to indicate, at a glance, whether the dishes in the washer are clean and ready for removal or are dirty ready to be washed.

A dishwasher cycle visual indicator system is disclosed herein preferably comprising: a dishwasher cycle visual indicator assembly including a housing having a front-side, a back-side, a top-side, a bottom-side, a left-side, a right-side, and an inner-volume; a plurality of lights for displaying at least one message according to a condition realized within a dishwashing appliance; a powerer; a wiring assembly; a wireless receiver; and at least one attacher. The dishwasher cycle visual indicator system comprises the dishwasher cycle visual indicator assembly. The dishwasher cycle visual indicator assembly comprises in functional combination the housing, the plurality of lights, the powerer, the wiring assembly, the wireless receiver, and the at least one attacher (for removable versions).

The parameters of the housing are defined by the front-side, the back-side, the top-side, the bottom-side, the left-side, the right-side, all defining and enclosing the inner-volume. The front-side is transparent such that displays can be viewed therethrough. The housing is removably attachable to the dishwashing appliance, the back-side located adjacent the dishwashing appliance during use such that the at least one message is able to be viewed through the front-side. The housing is flexible in preferred embodiments. The housing comprises a 3-D rectangular profile. The at least one attacher is used to removably secure the housing to the dishwashing appliance for use; the at least one attacher located on the back-side of the housing. The at least one attacher comprises magnets.

The powerer powers the plurality of lights via the wiring assembly, the plurality of lights and the wiring assembly are located inside confines of the inner-volume. The plurality of lights preferably comprises LED-lights. The powerer comprises at least one battery on removable models. The plurality of lights when illuminated may comprise the at least one message as 'clean' preferably located on a left-portion of the housing. The plurality of lights when illuminated as the at least one message as 'dirty' is preferably located on a right-portion of the housing. The least one message comprises a digital-display and is alphanumeric. LED may display as green for example on clean and red on dirty. Other versions may both use white illumination.

The wireless receiver is able to communicate with an existing electrical system of the dishwashing appliance via a transceiver; the wireless receiver to receive and signal to display via the plurality of lights the at least one message according to a corresponding condition realized within the dishwashing appliance such that an individual is able to be readily apprised on the condition realized within the dishwashing appliance without having to open the dishwashing appliance.

The present invention holds significant improvements and serves as a dishwasher cycle visual indicator system (Dish Washer Sign Systems). For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, dishwasher cycle visual indicator system, constructed and operative according to the teachings of the present invention.

The various embodiments of the present invention will hereinafter be described in conjunction with the appended drawings, wherein like designations denote like elements.

DETAILED DESCRIPTION

In view of the foregoing disadvantages inherent in the known of notification devices art, the present invention provides a novel dishwasher cycle visual indicator system (Dish Washer Sign Systems). The general purpose of the present invention, which will be described subsequently in greater detail is to provide a specially designed dishwasher cycle visual indicator system to indicate, at a glance, whether the dishes in the washer are clean and ready for removal or are dirty.

Generally speaking, the Dish Washer Sign (dishwasher cycle visual indicator system) comprises a specially designed two-panel, LED-backlit sign designed to fasten removably to the front facing of a dishwasher machine, and displaying, through the operation of a switch or dial, a message that the dishes within the washer are "CLEAN" or are "DIRTY."

The sign may be produced in a lightweight metal alloy, and fasten removably to the dishwasher by means of one or more magnets; or it may be produced in lightweight injection-molded thermoplastic, and adhere removably to the dishwasher facing with a peel-n-stick set of VELCRO® strips. The present invention preferably is backlit with a series of LEDs (Light-Emitting Diodes), and these may be powered by one or more batteries (cell type unspecified) which load into a rear-mounted battery compartment. The Dish Washer Sighs two modes—"CLEAN" and "DIRTY"—may themselves be LED signs, activated by a simple left/right toggle switch. More economical in operation would be a sliding panel configuration, in which an opaque panel is simply shifted along a channel from one side to the other, this panel covering the non-operative message and conveying the operative one. Such a sliding panel or "window" design may work equally well in a rectangular and a circular configuration.

The Dish Washer Sign is an invention with a single purpose—to show consumers, at a glance, whether the dishes in the washer are clean, and ready to be put away, or dirty and in need of washing. Use of the sign is relatively simple. When a load of dishes has been washed and put away and the dishwasher emptied, a member of the household would simply set the sign to "DIRTY"; this would remain in effect until the dishwasher was full and the next washing cycle started, at which point the sign would simply be shifted to the "CLEAN" state. Through this simple protocol, householders would save time and trouble, because they would no longer repeat the action of opening the dishwasher door, time and time again, to determine whether the dishes were clean or dirty: A simple, momentary inconvenience, perhaps, but one that is experienced on a daily basis over and over again across the country and around the developed world. Simple, easy to use, and effective in its single purpose, the Dish Washer Sign would install removably, and not mar the dishwasher's finish nor impede its operation.

Figure 1:
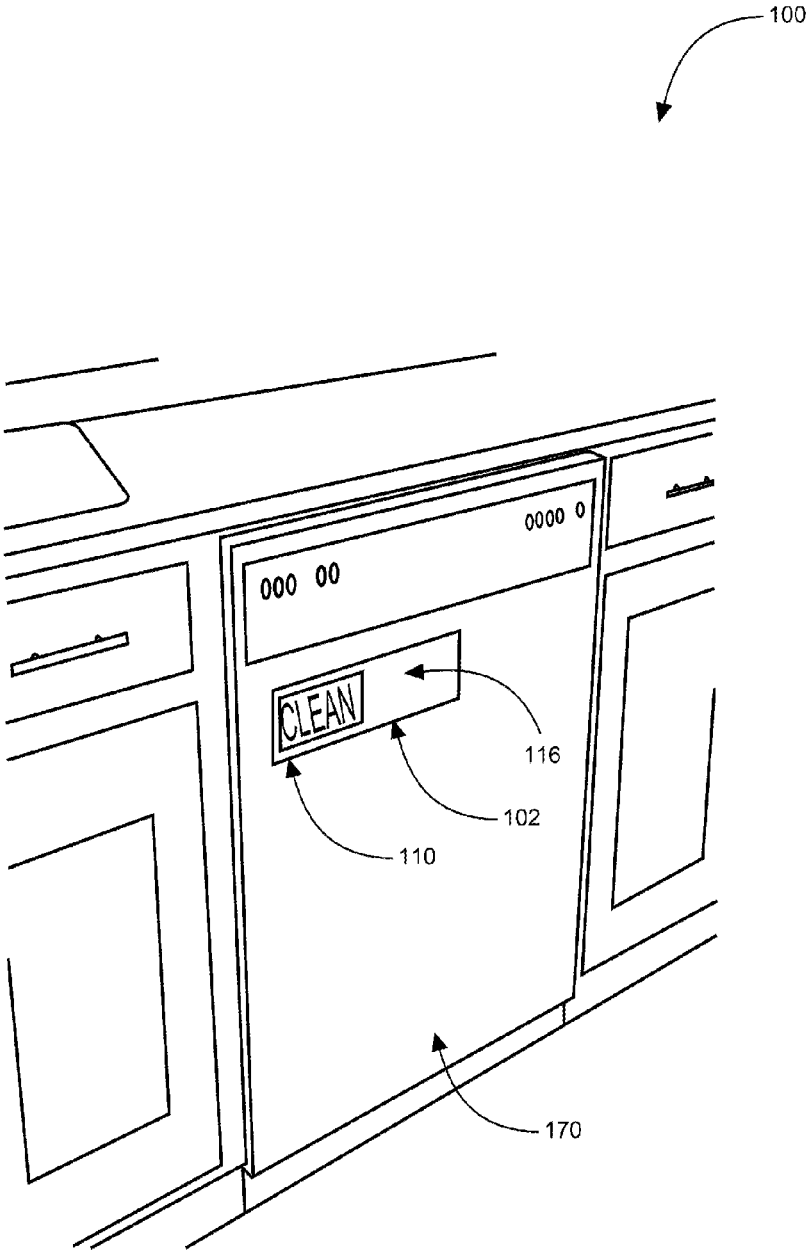
FIG. 1 shows a perspective view illustrating a dishwasher cycle visual indicator system in an in-use condition use condition according to an embodiment of the present invention.
Figure 2:
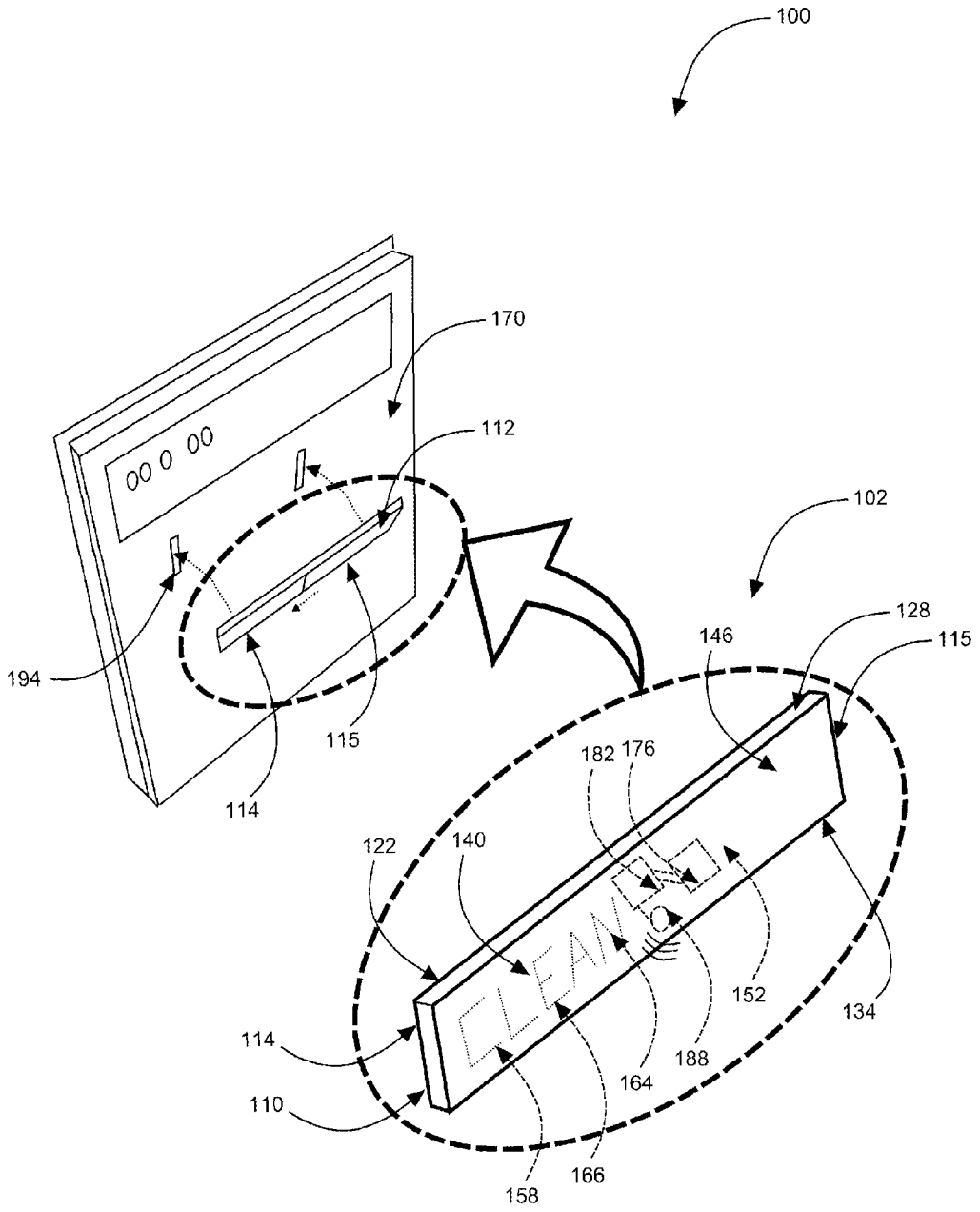
FIG. 2 is a perspective view illustrating a dishwasher cycle visual indicator assembly of the dishwasher cycle visual indicator system according to an embodiment of the present invention of FIGS. 1 and 3.
Figure 3:
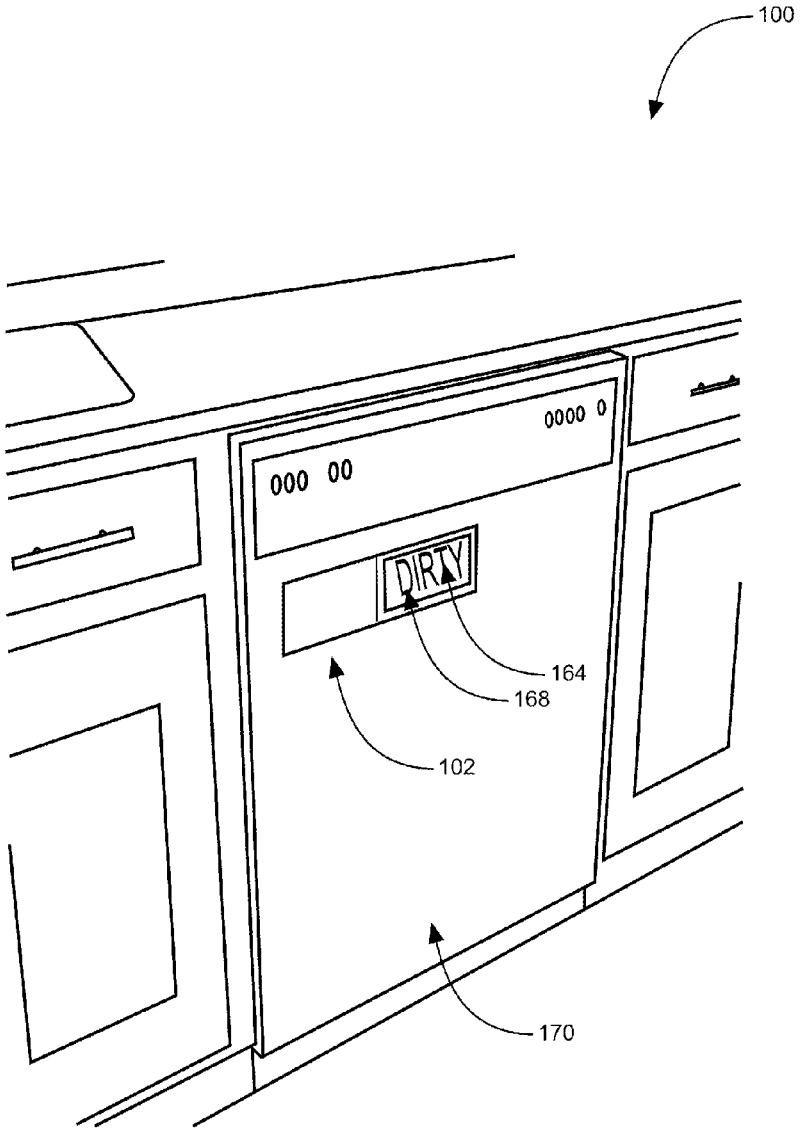
FIG. 3 is a perspective view illustrating the dishwasher cycle visual indicator assembly of the dishwasher cycle visual indicator system in another in-use condition according to an embodiment of the present invention of FIG. 1.

Referring to the drawings by numerals of reference there is shown in FIGS. 1-3, perspective views illustrating dishwasher cycle visual indicator system 100 according to an embodiment of the present invention.

Dishwasher cycle visual indicator system 100 preferably comprises: dishwasher cycle visual indicator assembly 102 including housing 110 having front-side 116, back-side 122, top-side 128, bottom-side 134, left-side 140, right-side 146, and inner-volume 152; plurality of lights 158 (for displaying at least one message 164 according to a condition realized within dishwashing appliance 170); powerer 176; wiring assembly 182; wireless receiver 188; and at least one attacher 194. As such, dishwasher cycle visual indicator system 100 comprises dishwasher cycle visual indicator assembly 102. Dishwasher cycle visual indicator assembly 102 comprises in functional combination housing 110, plurality of lights 158, powerer 176, wiring assembly 182, wireless receiver 188, and at least one attacher 194.

The parameters of housing 110 are defined by front-side 116, back-side 122, top-side 128, bottom-side 134, left-side 140, right-side 146, all defining and enclosing inner-volume 152. Front-side 116 is preferably transparent. Housing 110 is removably attachable to dishwashing appliance 170, back-side 122 located adjacent dishwashing appliance 170 during use such that at least one message 164 is able to be viewed through front-side 116. Housing 110 is preferably flexible. Further, housing 110 preferably comprises a 3-D rectangular profile, as shown. Housing 110 may further comprise sliding panel 112. At least one attacher 194 is used to removably secure housing 110 to dishwashing appliance 170 for use, at least one attacher 194 located on back-side 122 of housing 110.

At least one attacher 110 may comprises magnets. Upon reading this specification, it should be appreciated that, under appropriate circumstances, considering such issues as user preferences, design preference, structural requirements, marketing preferences, cost, available materials, technological advances, etc., other attacher arrangements such as, for example, hook and loop, etc., may be sufficient.

Powerer 176 powers plurality of lights 158 via wiring assembly 182; plurality of lights 158 and wiring assembly 182 are located inside confines of inner-volume 152. Plurality of lights 158 comprises LED-lights in preferred embodiments due to their relative efficiency. Powerer 176 comprises at least one battery (not shown). The at least one battery may be rechargeable At least one message 164 comprises a digital-display and is alphanumeric. At least one message 164 comprises a digital-look-reading, as shown. Plurality of lights 158 when illuminated as at least one message 164 as 'clean' 166 is located on left-portion 114 of housing 110. Plurality of lights 158 when illuminated as at least one message 164 as 'dirty' 168 is located on right-portion 115 of housing 110.

Wireless receiver 188 is able to communicate with an existing electrical system of dishwashing appliance 170 via a transceiver (not shown), wireless receiver 188 to receive and signal to display via plurality of lights 158 at least one message 164 according to a corresponding condition realized within dishwashing appliance 170 such that an individual is able to be readily apprised on the condition realized within dishwashing appliance 170 without having to open dishwashing appliance 170. Means of providing wireless communication and display are readily known by those skilled in the art.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A dishwasher cycle visual indicator system comprising:
a dishwasher cycle visual indicator assembly including;
a housing having;
a front-side;
a back-side;
a top-side;
a bottom-side;
a left-side;
a right-side; and
an inner-volume;
a plurality of lights for displaying at least one message according to a condition realized within a dishwashing appliance;
a powerer;
a wiring assembly;
a wireless receiver; and
at least one attacher;
wherein said dishwasher cycle visual indicator system comprises said dishwasher cycle visual indicator assembly;
wherein said dishwasher cycle visual indicator assembly comprises in functional combination said housing, said plurality of lights, said powerer, said wiring assembly, said wireless receiver, and said at least one attacher;
wherein parameters of said housing are defined by said front-side, said back-side, said top-side, said bottom-side, said left-side, said right-side, all defining and enclosing said inner-volume;
wherein said housing is removably attachable to said dishwashing appliance, said back-side located adjacent said dishwashing appliance during use such that said at least one message is able to be viewed through said front-side;
wherein said at least one attacher is used to removably secure said housing to said dishwashing appliance for use, said at least one attacher located on said back-side of said housing;
wherein said powerer powers said plurality of lights via said wiring assembly, said plurality of lights and said wiring assembly are located inside confines of said inner-volume; and
wherein said wireless receiver is able to communicate with an existing electrical system of said dishwashing appliance via a transceiver, said wireless receiver to receive and signal to display via said plurality of lights said at least one message according to a corresponding said condition realized within said dishwashing appliance such that an individual is able to be readily apprised on said condition realized within said dishwashing appliance without having to open said dishwashing appliance.

2. The dishwasher cycle visual indicator system of claim 1 wherein said at least one message comprises clean.

3. The dishwasher cycle visual indicator system of claim 2 wherein said clean, when illuminated as said at least one message is located on a left-portion of said housing.

4. The dishwasher cycle visual indicator system of claim 1 wherein said at least one message comprises dirty.

5. The dishwasher cycle visual indicator system of claim 4 wherein said dirty, when illuminated as said at least one message is located on a right-portion of said housing.

6. The dishwasher cycle visual indicator system of claim 1 wherein said plurality of lights comprises LED-lights.

7. The dishwasher cycle visual indicator system of claim 1 wherein said at least one attacher comprises magnets.

8. The dishwasher cycle visual indicator system of claim 1 wherein said at least one attacher comprises hook and loop.

9. The dishwasher cycle visual indicator system of claim 1 wherein said housing is flexible.

10. The dishwasher cycle visual indicator system of claim 1 wherein said housing comprises a 3-D rectangular profile.

11. The dishwasher cycle visual indicator system of claim 1 wherein said at least one message comprises a digital-look-reading.

12. The dishwasher cycle visual indicator system of claim 1 wherein said powerer comprises at least one battery.

13. The dishwasher cycle visual indicator system of claim 12 wherein said at least one battery is rechargeable.

14. The dishwasher cycle visual indicator system of claim 1 wherein said front-side is transparent.

15. The dishwasher cycle visual indicator system of claim 1 wherein said at least one message is alphanumeric.

16. The dishwasher cycle visual indicator system of claim 1 wherein said housing further comprises a sliding panel.

17. A dishwasher cycle visual indicator system comprising:
a dishwasher cycle visual indicator assembly including;
a housing having;
a front-side;
a back-side;
a top-side;
a bottom-side;
a left-side;
a right-side; and
an inner-volume;
a plurality of lights for displaying at least one message according to a condition realized within a dishwashing appliance;
a powerer;
a wiring assembly;

a wireless receiver; and at least one attacher;

wherein said dishwasher cycle visual indicator system comprises said dishwasher cycle visual indicator assembly;

wherein said dishwasher cycle visual indicator assembly comprises in functional combination said housing, said plurality of lights, said powerer, said wiring assembly, said wireless receiver, and said at least one attacher;

wherein parameters of said housing are defined by said front-side, said back-side, said top-side, said bottom-side, said left-side, said right-side, all defining and enclosing said inner-volume;

wherein said front-side is transparent;

wherein said housing is removably attachable to said dishwashing appliance, said back-side located adjacent said dishwashing appliance during use such that said at least one message is able to be viewed through said front-side;

wherein said at least one attacher is used to removably secure said housing to said dishwashing appliance for use, said at least one attacher located on said back-side of said housing;

wherein said housing is flexible;

wherein said housing comprises a 3-D rectangular profile;

wherein said powerer powers said plurality of lights via said wiring assembly, said plurality of lights and said wiring assembly are located inside confines of said inner-volume;

wherein said powerer comprises at least one battery;

wherein said plurality of lights comprises LED-lights;

wherein said at least one message comprises a digital-display;

wherein said at least one message is alphanumeric;

wherein said at least one attacher comprises magnets;

wherein said plurality of lights when illuminated as said at least one message as clean is located on a left-portion of said housing;

wherein said plurality of lights when illuminated as said at least one message as dirty is located on a right-portion of said housing; and wherein said wireless receiver is able to communicate with an existing electrical system of said dishwashing appliance via a transceiver, said wireless receiver to receive and signal to display via said plurality of lights said at least one message according to a corresponding said condition realized within said dishwashing appliance such that an individual is able to be readily apprised on said condition realized within said dishwashing appliance without having to open said dishwashing appliance.

* * * * *